US005659303A

United States Patent [19]

Adair, Jr.

[11] Patent Number: 5,659,303

[45] Date of Patent: Aug. 19, 1997

[54] METHOD AND APPARATUS FOR TRANSMITTING MONITOR DATA

[75] Inventor: Henry Harold Adair, Jr., Duluth, Ga.

[73] Assignee: Schlumberger Industries, Inc., Norcross, Ga.

[21] Appl. No.: 425,538

[22] Filed: Apr. 20, 1995

[51] Int. Cl.[6] ..... G08C 19/16

[52] U.S. Cl. ..... 340/870.18; 340/870.02; 340/870.03; 340/870.11; 340/870.26; 375/202

[58] Field of Search ..... 375/202; 379/59; 348/12; 340/870.01, 870.02, 870.03, 870.18, 870.11, 870.26; 455/102, 103, 71, 113

[56] References Cited

U.S. PATENT DOCUMENTS

| | | | |
|---|---|---|---|
| 4,103,250 | 7/1978 | Jackson | 331/1 A |
| 4,476,566 | 10/1984 | Dent | 375/1 |
| 4,638,417 | 1/1987 | Martin, Jr. et al. | 363/41 |
| 4,694,466 | 9/1987 | Kadin | 375/202 |
| 4,704,585 | 11/1987 | Lind | 331/114 |
| 4,791,377 | 12/1988 | Grandfield et al. | 328/14 |
| 4,965,531 | 10/1990 | Riley | 331/1 A |
| 5,179,569 | 1/1993 | Sawyer | 340/870.18 |
| 5,210,771 | 5/1993 | Schaeffer et al. | 375/1 |
| 5,235,613 | 8/1993 | Brown et al. | 375/202 |
| 5,255,086 | 10/1993 | McMullan et al. | 358/86 |
| 5,307,372 | 4/1994 | Sawyer et al. | 340/870.18 |
| 5,335,276 | 8/1994 | Thompson et al. | 380/21 |
| 5,386,435 | 1/1995 | Cooper et al. | 375/1 |
| 5,425,049 | 6/1995 | Dent | 375/202 |
| 5,430,761 | 7/1995 | Bruckert et al. | 375/200 |
| 5,438,329 | 8/1995 | Gastouniotis et al. | 340/870.02 |
| 5,455,962 | 10/1995 | Kotzin | 375/202 |
| 5,502,722 | 3/1996 | Fulghum | 375/202 |
| 5,519,388 | 5/1996 | Adair, Jr. | 340/870.02 |

*Primary Examiner*—Jeffery Hofsass
*Assistant Examiner*—Ashok Mannava
*Attorney, Agent, or Firm*—Leonard W. Pojunas

[57] ABSTRACT

A method and apparatus for transmitting data from a monitoring station using frequency hopping and interval hopping as described. The output frequency of a transmitter in the monitoring station is hopped between selected output frequencies by retrieving random numbers from a table, generating a control voltage corresponding to the retrieved random number, applying the control voltage to an RF oscillator and transmitting a signal from a transmitter in the monitoring station using the signal from the RF oscillator as a carrier. The output frequency of the transmitter is limited between a maximum output frequency and a minimum output frequency by comparing the retrieved random number to data limits stored in a memory in the transmitter and rejecting retrieved random numbers outside of the retrieved limits. Interval hopping is realized by selecting a random number from the random number table, multiplying the random number by a fixed increment and adding the product to a minimum time interval.

15 Claims, 6 Drawing Sheets

METHOD AND APPARATUS FOR TRANSMITTING MONITOR DATA

TECHNICAL FIELD

The present invention relates to a method and apparatus for transmitting data from a monitoring station at several frequencies and varied intervals.

BACKGROUND OF THE INVENTION

Several approaches to remotely collecting data from meter reading monitoring stations, such as those for gas and electric power meters, have been proposed.

In one system described in U.S. Pat. No. 4,614,945 to Brunius et al., multiple, battery-powered monitoring stations, such as gas meter monitors, are located throughout an area and each of the monitoring stations includes a transponder (referred to by Brunius as an Encoder/Receiver/Transmitter unit ("ERT")) for transmitting radiowave signals corresponding to data collected by the monitoring station. A mobile data collection unit collects data by traveling through the area, activating the ERTs to transmit their radiowave signals and receiving and decoding the radiowave signals to identify the data. To activate the ERTs, the mobile unit includes a transmitter that emits a "wake-up" or "interrogation" signal. All ERTs within range of the mobile unit, upon receiving the interrogation signal, respond by transmitting their accumulated data by transmitting their identification codes and accumulated data a plurality of times by means of serially spaced bursts.

At times, the mobile unit may be within range of several ERTs simultaneously and, because the mobile unit does not uniquely poll the individual ERTs, it may energize all ERTs within range of the wake-up signal simultaneously. Because more than one ERT may begin transmission at the same time, their signals may "collide" at the mobile unit. That is, radiowave signals from several of the transponders may arrive at the mobile unit together, such that the receiver within the mobile unit receives a combination of the various signals from the transponders. In such a case, the signals may be difficult to detect or may result in an incorrect signal being detected by the receiver.

Brunius treats the problem of signal collision by having the time interval between successive transmission bursts be determined as a function of the identification code of the transponder unit such that, with each transponder being assigned an identification code differing from other transponders in the area, the temporal spacing between bursts will differ between transponders. Nevertheless, the initial bursts may occur at the same time.

Brunius also varies the transponder frequency to address the problem of collisions. Each transponder, upon receiving the wake-up signal, begins transmission at a preset transmission frequency, and successive transmissions by the transponder are shifted to different frequencies. The frequency shift of successive transmissions is dependent upon the time interval, and thus the unit identification number.

Brunius does not teach a method of varying the frequency of the initial bursts. Instead, Brunius relies upon "tuning variances" to give differing initial frequencies of transmission. Because the Brunius system requires transmission and reception of wake up signal, it requires the mobile unit to include both a receiver and a transmitter and also requires the monitoring station to include a transponder to both transmit and receive data. Thus, though data transfer is unidirectional (from the monitor to the receiver) both the monitor and the receiver require transponders.

Because the Brunius units are battery powered, the units remain inactive in the absence of the "wake-up" signal to conserve power. Even though this intermittent activity may conserve some power, the batteries within the units still must be replaced eventually. Often, such replacement of the batteries requires removal of the monitoring meter. Governmental regulations require meters to be recalibrated whenever they are removed, so battery replacement typically involves returning the meter to a repair facility for recalibration.

An additional problem that must be addressed in remote data collection systems is confinement of transmission within specified frequency limits. The amount of allowable frequency variation is limited by various factors. For example, the available frequency band is prescribed by governmental regulation and depends upon the characteristics of the transmitters and receivers.

It is therefore necessary to control the output frequency of the transmitters within the system such that transmissions are limited to a predetermined frequency range. While the frequency range may be defined somewhat by the design of the system, tight control of the output frequency is often difficult without complex systems, such as those using precision components or feedback configurations.

Moreover, because the monitors may operate over a wide range of operating environments, including wide temperature variations, component values may vary. Consequently, the output frequencies may drift outside of the design limits as the operating temperature changes.

SUMMARY OF THE INVENTION

An apparatus for generating a continuous series of radiowave signals is described. Each signal includes a group of bursts, with each burst having a respective frequency as well as a starting time and an ending time with a selected fixed time period between bursts in the group. Each group is separated from a previous group by a respective time interval. The apparatus includes a memory containing a plurality of memory locations each containing a random number. A first counter produces a series of frequency pointers with each frequency pointer identifying one of the memory locations. An integrated memory controller is connected to receive the frequency pointers from the first counter and retrieves random numbers from the locations identified by the frequency pointer. In response to the retrieved random numbers, the controller produces data sequences which are input to a digital control input of a voltage supply. The voltage supply produces supply voltages corresponding to the data sequences retrieved at the digital control input. A voltage controlled oscillator receives the supply voltages and produces radio frequency signals at frequencies corresponding to the supply voltages. Operational data from a monitoring station is used to modulate the radio frequency signal through On-Off keying. A microstrip antenna within the oscillator transmits the modulated radio frequency signals. In one embodiment, the voltage supply is a D/A converter. A mobile unit travels within a transmission area of the apparatus and receives the transmitted signal. The mobile unit decodes the transmitted signal to identify the operational data. The monitoring stations draw power from the electrical line serving their respective facilities allowing continuous operation without a "wake-up" signal and eliminating the need for battery replacement.

To maintain the radiowave signals within maximum and minimum frequency limits, the apparatus further includes a limit memory containing limiting data corresponding to a maximum frequency and a minimum frequency. The memory controller is connected to retrieve the limiting data and to prevent the voltage generator from producing supply voltages corresponding to frequencies greater than the maximum frequency or less than the minimum frequency. In one embodiment, the oscillator includes a coarse adjust input and a fine adjust input. In this embodiment, the memory controller is connected to provide a coarse adjust voltage to the coarse adjust input and the voltage generator is connected to provide the supply voltage to the fine adjust input.

The apparatus also includes an interval selector connected to retrieve random numbers from the random number table. The interval selector employs an interval pointer to identify random numbers to retrieve from the random number table. The interval selector selects each of the time intervals between groups in response to the retrieved random numbers such that the time intervals vary randomly.

In a method of transmitting operational data produced by a monitoring station from the monitoring station to a remotely located receiver, a plurality of random numbers are generated and stored in respective locations in a random number memory. A first pointer is produced to identify a first one of the locations and a second pointer is produced to identify a second one of the locations. A data sequence is retrieved from the location identified by the first pointer and a control voltage corresponding to the retrieved data sequence is generated in response to the data sequence. A data sequence is also retrieved from the location identified by the second pointer and a transmission interval is determined in response to the data sequence retrieved from the location identified by the second pointer. A transmitter generates a carrier signal having a frequency corresponding to the control voltage and the operational data is combined with the carrier signal to produce a radiowave signal which is transmitted after the transmission interval. An antenna transmits the radiowave signal which is then received by the receiver. The radiowave signal is produced from a group of identical bursts separated by a fixed time period. In one embodiment, a controller within the monitoring station provides a coarse adjust voltage to establish the frequency range from which the frequency of the radiowave signal is selected.

DETAILED DESCRIPTION OF THE INVENTION

Figure 1:
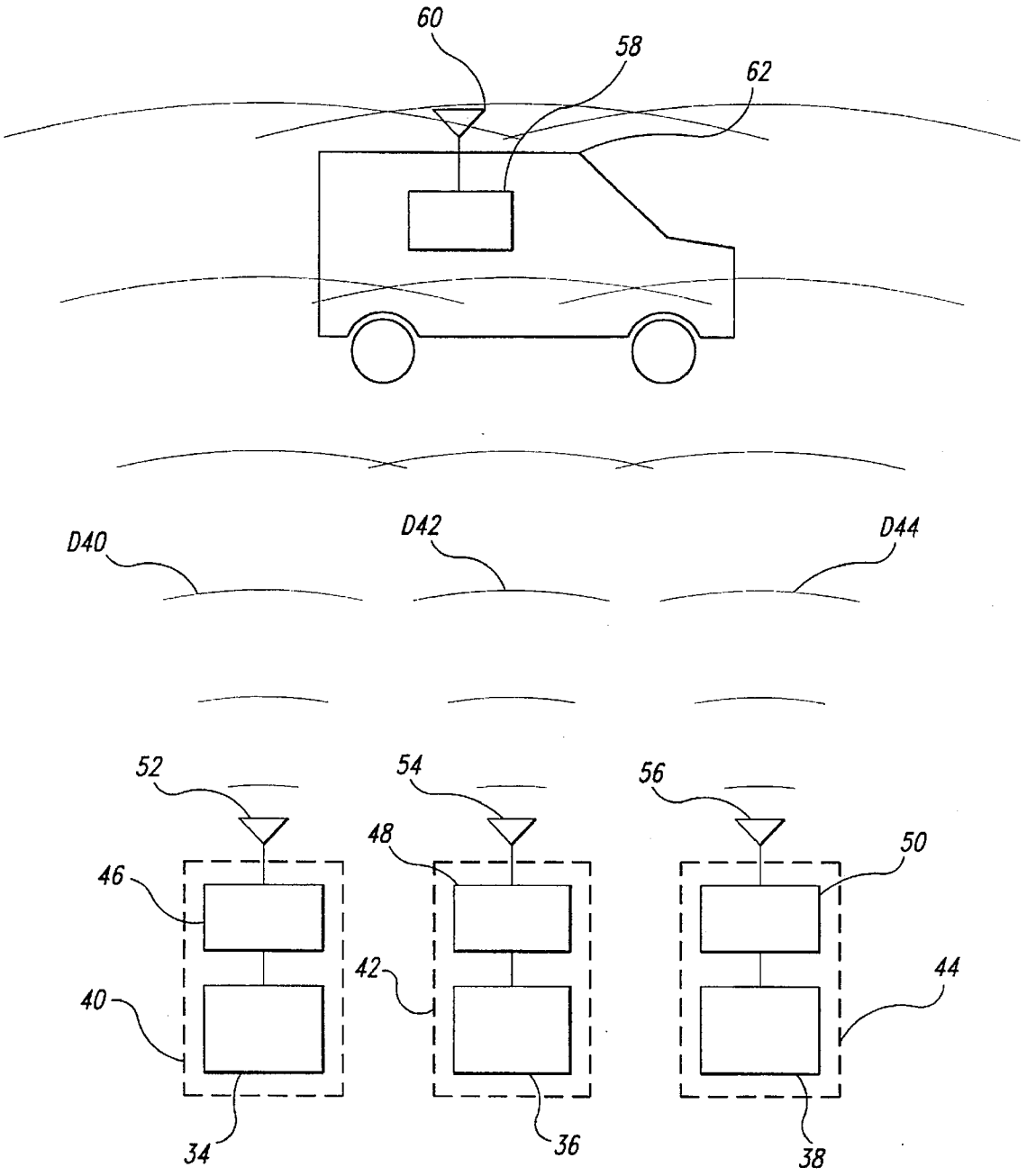
FIG. 1 is a representational view of a system according to the invention including three monitoring stations and a mobile receiver.

As shown in FIG. 1, three monitoring stations 40, 42, 44 are spaced apart in a data collection area. The monitoring stations 40, 42, 44 are data gathering stations including power monitors 34, 36, 38 such as power meters used in typical residences or other facilities to monitor electrical power usage. Because the monitoring stations 40, 42, 44 are used primarily for monitoring power, they are equipped to draw power from the electrical line serving the facility eliminating the need for battery-powered operation and eliminating the need for battery replacement. While only three monitoring stations 40, 42, 44 are shown for clarity of presentation, it will be understood that the number of stations may be significantly higher.

Each of the monitoring stations 40, 42, 44 includes a respective transmitter 46, 48, 50 transmitting radiowave signals D40, D42, D44 with a respective microstrip antenna 52, 54, 56 within the transmitter. Because the monitoring stations 40, 42, 44 do not operate on battery power, they are not strictly limited by power use constraints and can operate continuously without need for a "wake-up" signal. The radiowave signals D40, D42, D44 consist of finite duration "bursts" emitted by the antennas 52, 54, 56. Each of the bursts is formed by an antenna driver 65 within the oscillator by modulating a carrier signal at a respective output frequency $f_{out}$ with a digital sequence representing data collected by the monitors 34, 36, 38 using On-Off keying. Each digital sequence includes a first portion representing the monitored information, a second portion representing the identification number of the unit and a third portion representing other information, such as the unit type and tamper information. The transmission of each burst is repeated several times to form a group with each burst in the group being separated from the preceding burst by a selected time period and each group being separated by a selected interval.

The groups of bursts are received by a mobile receiver 58 having a receiving antenna 60 that is driven past the monitoring stations 40, 42, 44 in a van 62. Upon receiving the group, the receiver 58 decodes them to obtain their digital sequences. The receiver 58 then stores the data for later communication to a central system which uses the data to calculate power usage, generate power bills, and identify meter tampering.

As represented by the intersecting signals D40, D42, D44 in FIG. 1, the receiving antenna 60 may be simultaneously within range of more than one of the signals D40, D42, D44. If no action is taken to prevent the signals D40, D42, D44 from "colliding," the signals D40, D42, D44 may arrive simultaneously at the receiver 58, interfering with each other and causing data loss or miscommunication. To minimize such collisions, the intervals between the groups of bursts and the output frequencies $f_{out}$ of each of the signals D40, D42, D44 are varied randomly, as discussed below with respect to FIG. 2. This reduces the possibility that any two signals will arrive with the same frequency and at the same time to the receiver 58, thereby minimizing the risk of data collision at the receiver.

While the output frequency $f_{out}$ of each of the transmitters 46, 48, 50 may be varied, the frequency range over which the transmitters may transmit is limited between a maximum frequency $f_{max}$ and a minimum frequency $f_{min}$. The maximum frequency $f_{max}$ and minimum frequency $f_{min}$ may be established by operational parameters of the receiver 58 or by governmental regulation. The transmitters 46, 48, 50 must therefore limit their respective output frequencies $f_{out}$ to the allowed frequency range.

Figure 2:
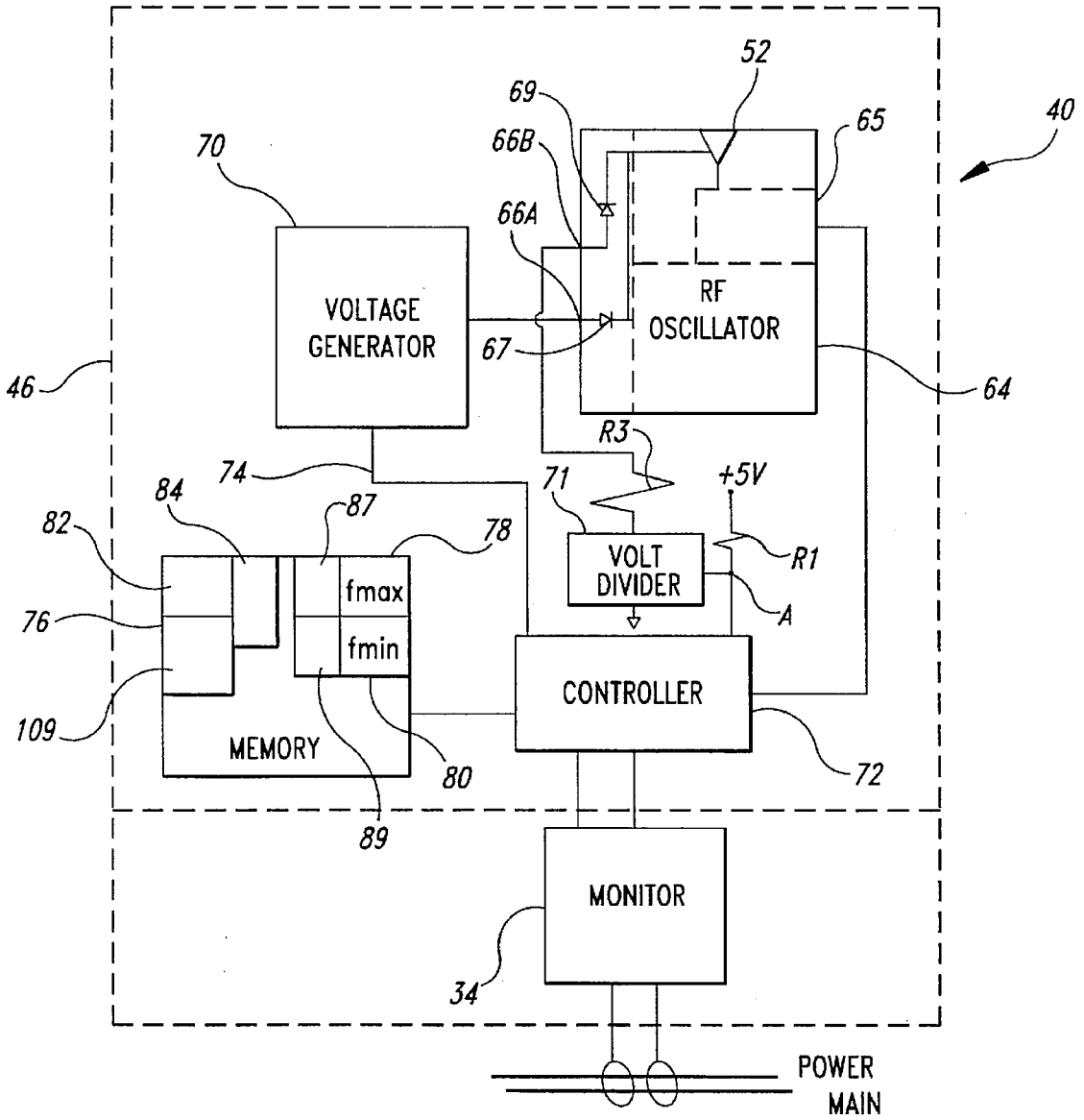
FIG. 2 is a block diagram of a monitoring station including a transmitter according to the invention.

Variation of output frequencies is best explained using the block diagram structure of the monitoring station 40 as presented in FIG. 2. Operation of the monitoring station 40 and interface between the transmitter 46 and monitor 34 is controlled by an integrated controller 72. The controller 72 may be a microprocessor or may be implemented with another integrated device, such as a microcontroller.

Within the transmitter 46 is a voltage controlled oscillator 64 that produces a radiowave signal at a frequency $f_{out}$ to drive the antenna 52 through an antenna driver 65. The oscillator's output frequency $f_{out}$ is determined upon the voltage levels of control voltages applied to a pair of control inputs 66A, 66B. RF oscillators producing output frequencies dependent upon input control voltages are known. Such RF oscillators typically use the capacitance of a varactor within a reactive circuit to establish an output frequency. By varying the voltage applied to the varactor, the capacitance of the varactor is altered, changing the output frequency of the oscillator.

In the embodiment shown in FIG. 2, the oscillator 64 has two control inputs, a fine control 66A and a coarse control 66B to allow an increased range of frequency control. This dual control is realized using two varactors, a fine adjust varactor 67 and a coarse adjust varactor 69. The coarse adjust varactor 69 receives three control voltage levels to place the output frequency $f_{out}$ in one of three ranges, low, medium, and high. The fine adjust varactor 67 receives a fine adjust voltage to set the output frequency $f_{out}$ to selected frequencies within the range established by the coarse adjust varactor 67.

The coarse adjust varactor 69 is referenced to 5 volts by connection to the microstrip antenna 52 which is biased at 5 volts. The controller 72 then establishes the three coarse voltages for the coarse adjust varactor 69 with a logic output referenced to 5 volts by a pull-up resistor R1 through a node A. A voltage divider 71 is connected between the node A, ground and an isolation resistor R3. The isolation resistor R3 delivers the coarse adjust control voltage from the voltage divider to the coarse control 66B.

The three voltage levels depend upon the logic level of the logic output, the voltage divider 71, and the value of the resistor R1. To select one of the three levels, the controller 72 sets the logic output to a high, open, or low state. When the logic output is set to high, the voltage at the node A is established at 5 volts, causing 0.5 volts to be applied across the varactor diode 69 through the isolation resistor R3. When the logic output is set to open, the voltage at the node A is established by the resistor divider formed by the pull-up resistor R1 and the voltage divider 71. This voltage is reduced by the voltage divider 71 and is applied through the isolation resistor to the varactor diode 69. When the controller output is set to low, the controller 72 pulls the voltage at the node A down and the voltage across the varactor diode is approximately 5 volts.

The fine control voltage is supplied by a voltage generator 70 in response to a digital data sequence provided by the controller 72 to the voltage generator 70 along a data bus 74. A 6-bit data sequence is used so that the voltage generator 70 may be realized using a 6-bit D/A converter. The controller 72 can therefore select the output frequency $f_{out}$ by setting the coarse adjust voltage to the selected frequency range, and supplying a 6-bit data sequence to the voltage generator 70.

The data sequence provided by the controller 72 to the voltage generator 70 is determined in response to data retrieved from a memory 76. The memory 76 includes several memory portions containing control data for operating the monitoring station 40. The structure of the memory 76 and selection of the data is discussed in greater detail below with respect to FIG. 3.

Because the output frequency $f_{out}$ depends upon the control voltages, the maximum and minimum frequencies $f_{max}$, $f_{min}$ for each coarse voltage correspond to a minimum fine control voltage $v_{min}$ and maximum fine control voltage $v_{max}$, respectively. The minimum and maximum fine control voltages in turn correspond to minimum and maximum values of the 6-bit data sequences retrieved from the memory 76. Because the electrical characteristics of each of the components within the monitoring stations 40, 42, 44 may vary from station to station, the 6-bit data sequences corresponding to the maximum frequency $f_{max}$ and the minimum frequency $f_{min}$ may vary from unit to unit. Therefore, each unit must be tuned to identify the 6-bit data sequences corresponding to the maximum frequency $f_{max}$ and the minimum frequency $f_{min}$. The 6-bit data sequences for room temperature (25° C.) are identified using a tuning station (not shown) and are stored in corresponding limit memory locations 78, 80 in the memory 76 along with an additional 2-bit sequence representing the coarse adjust setting (low, medium, high) at 25° C.

In addition to varying from unit to unit, the data sequences corresponding to the minimum and maximum frequencies $f_{min}$, $f_{max}$, vary according to temperature, as determined by the temperature-dependent electrical characteristics of the components. To accommodate the varying limits, an action table 82 is used to compensate the fine adjust limits by providing a link to a fine adjust table 84 which contains pairs of secondary limits each corresponding to specified frequency ranges.

Figure 3:
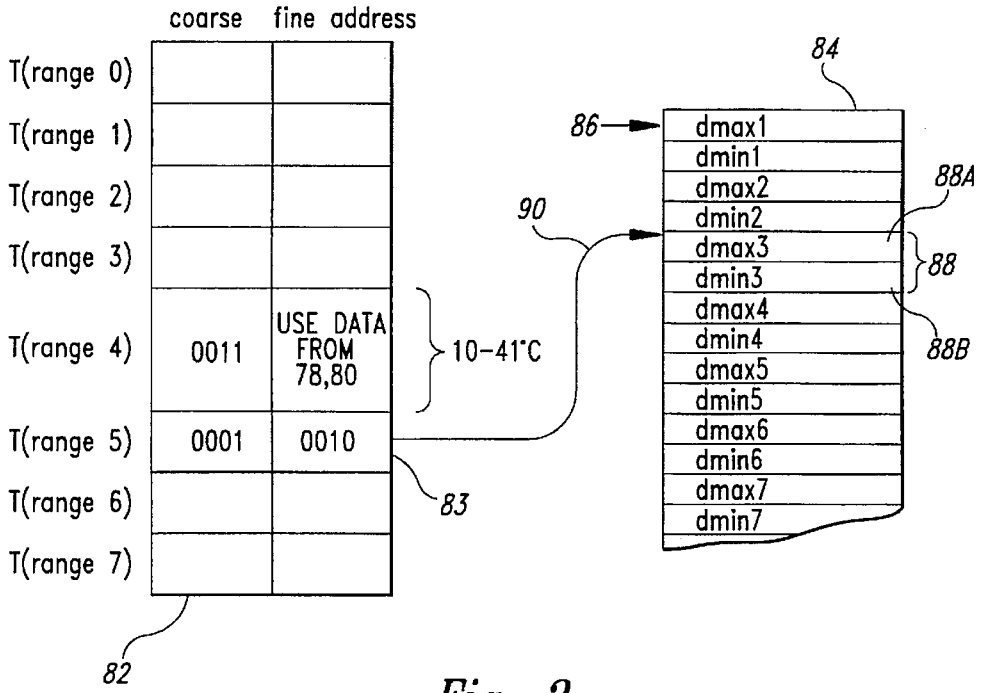
FIG. 3 is a diagram of a data structure showing an action table and a fine adjust table.

The data structure used to store the 2-bit coarse adjustment settings and the 6-bit data sequences for fine adjustment is presented in FIG. 3. The data is stored in two parts, a first part stored in the action table 82 and a second part stored in the fine adjust table 84. To allow data in the tables to be updated, the memory 76 in which the data is held is an erasable read-only memory, such as an EEPROM. The action table 82 has eight memory locations, each corresponding to a discrete temperature range T0–T7 and each containing an 8-bit byte. An example of an 8-bit byte is given by the sequence 00010010 in location 83 corresponding to temperature range T5. As represented by the divider line in the action table 82, each of the 8-bit bytes is broken into two 4-bit subsequences or nibbles.

The first 4-bit nibble determines the coarse adjust voltage. As discussed above, the coarse adjust voltage is limited to three possibilities (low, medium, and high). Therefore, only the two least significant bits of the coarse adjust 4-bit nibble are required to select the coarse adjust voltage. The remaining 2-bits are reserved for later development of the system. A "01" sequence represents a low range of the coarse adjust (i.e., the node A of FIG. 2 is pulled down to a zero level). Similarly, a 10 or 11 sequence represents tuning to the medium level and a 00 sequence represents tuning to a high level.

The second 4-bit nibbles of the 8-bit bytes in the action memory 82 represent pointers relative to a starting address of the fine adjust table 84. The fine adjust table 84 contains 32 bytes grouped in pairs, with each pair of bytes containing a pair of data sequences representing the maximum and minimum 6-bit data sequences for the frequency range. If the temperature is within the 10°–41° C. range, the maximum and minimum values are set to hexadecimal "FF," representing an invalid fine adjust setting. The microprocessor 72 responds to the invalid data by retrieving the fine adjust data directly from the memory 76. The byte containing the maximum data sequence is selected by identifying the starting address 86 of the fine adjust table and adding two times the 4-bit nibble to the starting address 86. The byte containing the minimum data sequence is the immediately next byte in the fine adjust table 84.

For example, for the 8-bit data sequence in the memory location 83, the 4-bit nibble 0010 represents a binary 2. This indicates that the third pair (00 is a valid count representing the first byte) of bytes 88 in the fine adjust table 84 will be used. The address of the first 6-bit data sequence in the third pair of bytes 88 is the starting address 86 plus two times the binary sequence 0010 (or the starting address plus 4) as indicated by the pointer arrow 90 in FIG. 3. If the data retrieved from the fine adjust table 84 is a hexadecimal FF, the microprocessor 72 recognizes the data as invalid and retrieves the fine adjust data directly from the memory 76. As discussed above, once the maximum and minimum data sequences are retrieved from the fine adjust table 84 (or the values from the memory 76), they are used to establish allowable data sequences to be applied to the voltage generator 70 to produce the fine adjust control voltage at the input 66A of the RF oscillator. The actual data sequences to be applied to the voltage generator 70 are selected from a random number table 109 presented in FIG. 6 according to the pointer system. The random number table 109 is stored in the memory 76 and includes 256 memory locations with each memory location identified by an 8-bit offset address referenced to the staring address 111 of the random number table 109. For example, if the starting address 111 is 2068, an 8-bit offset address of 0000011 would be the third memory address after 2068 or memory address 2071. Each of the memory locations contains a 6-bit randomly generated number. Together with the coarse adjust voltage applied to the coarse input 66B of the RF oscillator the fine adjust voltage determines the output frequency $f_{out}$ of the RF oscillator.

Figure 4:
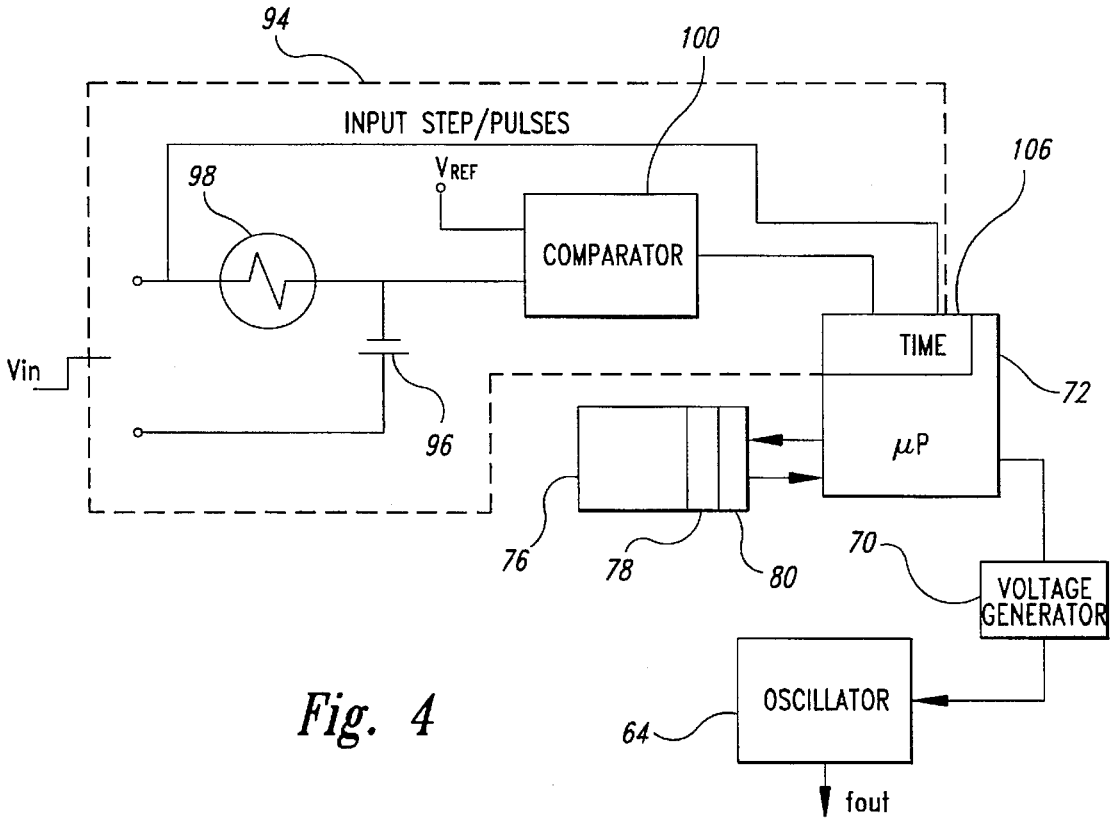
FIG. 4 is a block diagram of an apparatus for temperature compensation, including a temperature sensor circuit.

In order to select the proper 8-bit byte from the action table 82, the monitoring station must first determine the operating temperature range. To determine the operating temperature range, the monitoring station, includes a temperature sensing circuit 94 as shown in FIG. 4. The temperature sensing circuit 94 determines temperature by detecting a temperature-dependent variation in rise time of the voltage across a capacitor 96 in an RC circuit. To make the rise time of the capacitor voltage temperature dependent, the resistive component of the RC circuit is realized with a thermistor 98 in thermal contact with the transmitter 46. Thus, as the temperature of the transmitter 46 varies, the resistive component of the RC circuit varies accordingly. As is known, for a step voltage input the rise time of the voltage across the capacitor 96 depends upon the impedance of the thermistor 98. Thus, the time it takes for the capacitor voltage to reach a selected reference voltage will correspond to the temperature of the transmitter 46.

To determine when the voltage across the capacitor 96 reaches the reference voltage, the capacitor voltage is applied to one input 102 of a comparator 100 and the reference voltage is applied to the second input 104. The comparator 100 produces an output signal when the capacitor voltage reaches the reference voltage. The output signal from the comparator 100 is input to a first input of a timer 106 and the step voltage is applied to a second input of the timer. The timer 106 can thus measure the time difference between the leading edge of the step input voltage and the time when the capacitor voltage reaches the reference voltage, giving a measurement of the rise time of the capacitor voltage.

While the timer 106 could be realized with a conventional component, the timer in the preferred embodiment is realized using a timed program loop in the controller 72 to reduce the number of components. The timed program loop is a software loop in the controller 72 having a fixed duration. The controller 72 determines the rise time by counting the number of times the loop is performed while the capacitor voltage rises to the reference voltage.

Because the number of program loops is temperature dependent, the action table 82 of FIG. 3 is established with each memory location in the action table corresponding to a range of loop counts. The controller 72 then identifies the location in the action table 82 by counting the number of loops and comparing the number of loops to the numbers corresponding to each of the memory locations in the action table. For example, at a temperature of 25° C., the thermistor value, capacitor value, and loop time may be chosen to allow the program loop to complete 12 loops before the capacitor voltage reaches the reference voltage. The temperature range T4 would then be assigned values between 9 and 16 program loops. If the program completed 17 program loops, the controller 72 would retrieve data from temperature range T5 which corresponds to 17–32 program loops.

The intervals between groups of bursts are varied within the predetermined limits, while the time periods between bursts within a group are constant. The minimum time spacing between bursts is typically not dependent upon temperature and is established as fixed part of the system design with the minimum spacing between bursts selected as 60 ms. The minimum time spacing is established by a software routine which runs before and after each burst is transmitted.

A data sequence representing the time increment is stored in an increment location 89. This data sequence and minimum time spacing established in software define the time interval between groups within the minimum and maximum limits, as described below with respect to FIG. 5.

Figure 5:
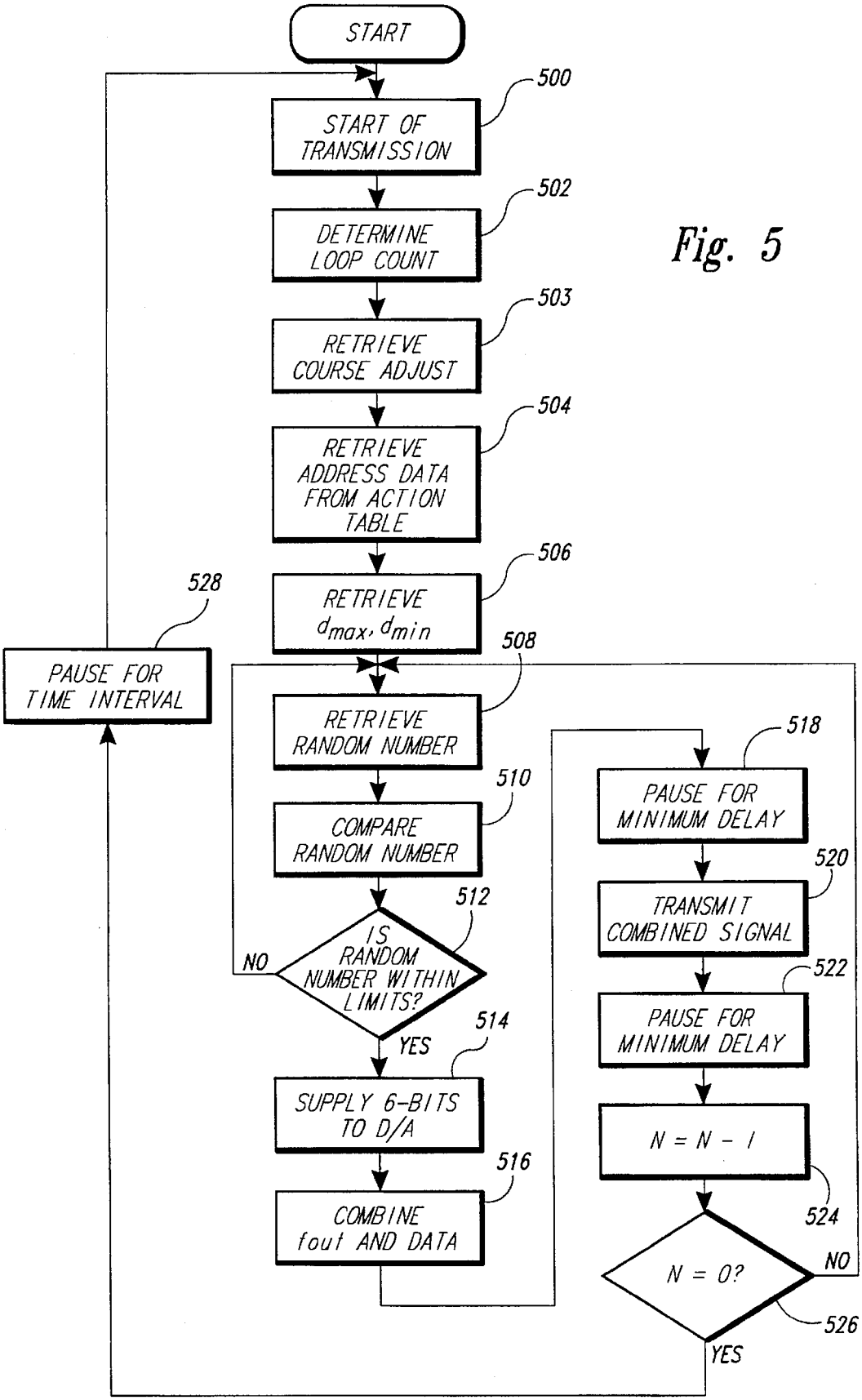
FIG. 5 is a flow chart showing the steps for frequency selection and transmission.

The process of selecting the output frequency and transmitting data is presented in flow diagram form in FIG. 5. The controller 72 initiates transmission of data by producing a Start of Transmission signal as shown in block 500. In response to the Start of Transmission signal the controller 72 applies the step voltage to the RC circuit and the temperature sensing circuit 94 determines the number of loops completed as the voltage of the capacitor 96 rises to the reference voltage in step 502. In response to the loop count, the controller 72 retrieves the 8-bit byte from the action table 82 in the memory 76.

The controller 72 extracts the 2 coarse select bits from the first 4-bit nibble to establish the coarse adjust voltage in step 503. Then, in step 504, the controller 72 identifies the addresses 88A, 88B in the fine adjust table 84 of the fine adjust data sequences corresponding to the maximum and minimum frequency. In step 506, the controller 72 retrieves the 6-bit fine adjust data sequences from the fine adjust table 84. The controller 72 then, in step 508, selects data from the random number table 109 shown in FIG. 6.

In step 510, after the controller 72 has retrieved the 6-bit random number, the controller 72 compares the random number to the 6-bit data sequences retrieved from the fine adjust table 84 in step 506. If, in step 512, the random number is within the limits specified by the data retrieved in step 506, the controller 72 provides the 6-bit random number to the voltage generator 70 in step 514 and the coarse voltage to the coarse input 66B of the oscillator 64. Alternately, the random number may be used as an address in a look-up table to determine an appropriate 6-bit data sequence for input to the D/A converter. This would be appropriate where desired output frequencies are unevenly spaced or where the response of the oscillator 64 is non-linear.

When the controller 72 provides the 6-bit data sequence, the voltage generator 70 supplies the fine adjust voltage to the fine adjust input 66A and, in response to the fine adjust voltage, the oscillator 64 produces the radiowave signal at the output frequency $f_{out}$ corresponding to the 6-bit data sequence from the random number table 109. The antenna driver 65 modulates the radiowave signal with the data from the monitor 34 in step 516 to form the burst and, in step 518, the transmitter 46 transmits the burst, pause for the minimum time spacing (60 ms), and repeats the steps from step 508 until the burst has been repeated a predetermined number N of times at the frequency of the radiowave signal.

Returning to decision block 512, if the random number is not within the limits, the controller 72 returns to step 508, where it retrieves another random number from the random number table 109. The loop is continued until a valid random number is found. After a valid random number is identified and data is transmitted successfully, the monitor 34 pauses for a random time interval as shown in step 520.

As noted above, the controller 72 retrieves data from the random number table 109 according to a pointer system. That is, the controller 72 includes a frequency pointer counter 124 indicating an address in the random number table 109. The controller 72 also includes an interval pointer counter 126 to allow the controller 72 to independently select random numbers to generate random intervals between bursts.

When the monitoring station 40 is initialized, the frequency pointer counter is initialized to a starting address 128 indicated by the last 8 bits of the 24- bit identification number of the monitoring station. This allows the monitoring station 40 to be initialized to a different output frequency $f_{out}$ than nearby stations. The frequency pointer is incremented or decremented each time data is retrieved from the random number table 109. The incrementing or decrementing of the pointer is controlled by the least significant bit of the unit identification number. If the least significant bit of the unit identification number is a "1," the frequency pointer is incremented. If the least significant bit is a "0," the frequency pointer is decremented.

Figure 7:
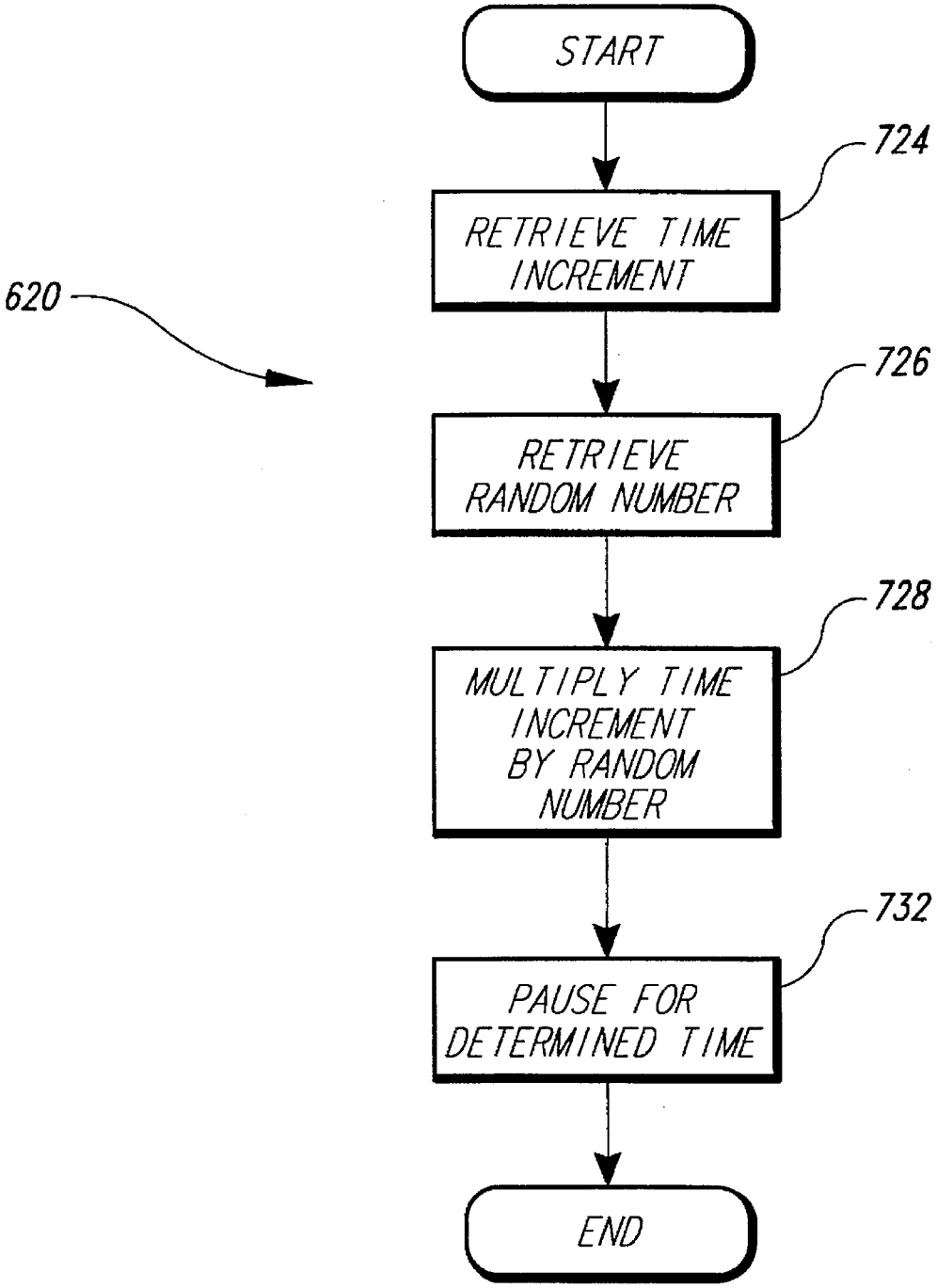
FIG. 7 is a flow chart showing the method of determining random time intervals.

The time interval is also selected in response to data retrieved from the random number table as shown by the detailed flow chart of FIG. 7 presenting the steps to realize the pause step 520 of FIG. 5. In the embodiment described above, the selected time increment is retrieved from the increment location 89 in step 724. A random number is then retrieved from the random number table 109 in step 726. The retrieved random number is then multiplied by the retrieved time increment in step 728 to give the total time interval. Because the random number is a 6-bit number, the maximum interval is limited to 63 times the time increment. For a 31.25 ms time increment this gives a maximum interval of 1.97 seconds $63*(31.25\times10^{-3})$. The controller 72 then causes a pause for the total interval in step 732.

To retrieve data from the random number table 109, in steps 508 and 726, the controller 72 uses a pointer system. That is, the controller 72 includes a frequency pointer counter 124 and a time pointer counter 126 indicating addresses in the random number table 109. When the monitoring station 40 is initialized, the initial pointers are set to the address indicated by the last eight bits of the 24-bit identification number of the monitoring station. The respective frequency and interval pointers are then incremented or they are used to retrieve data from the random number table 109. Thus, the time pointer and frequency pointer are initialized to the same value. The incrementing or decrementing of a pointer is established when the system is initialized in response to the least significant bit of the unit identification number. If the least significant bit of the unit identification number is a "1," the pointers are incremented. If the least significant bit is a "0," the pointers are decremented.

Figure 6:
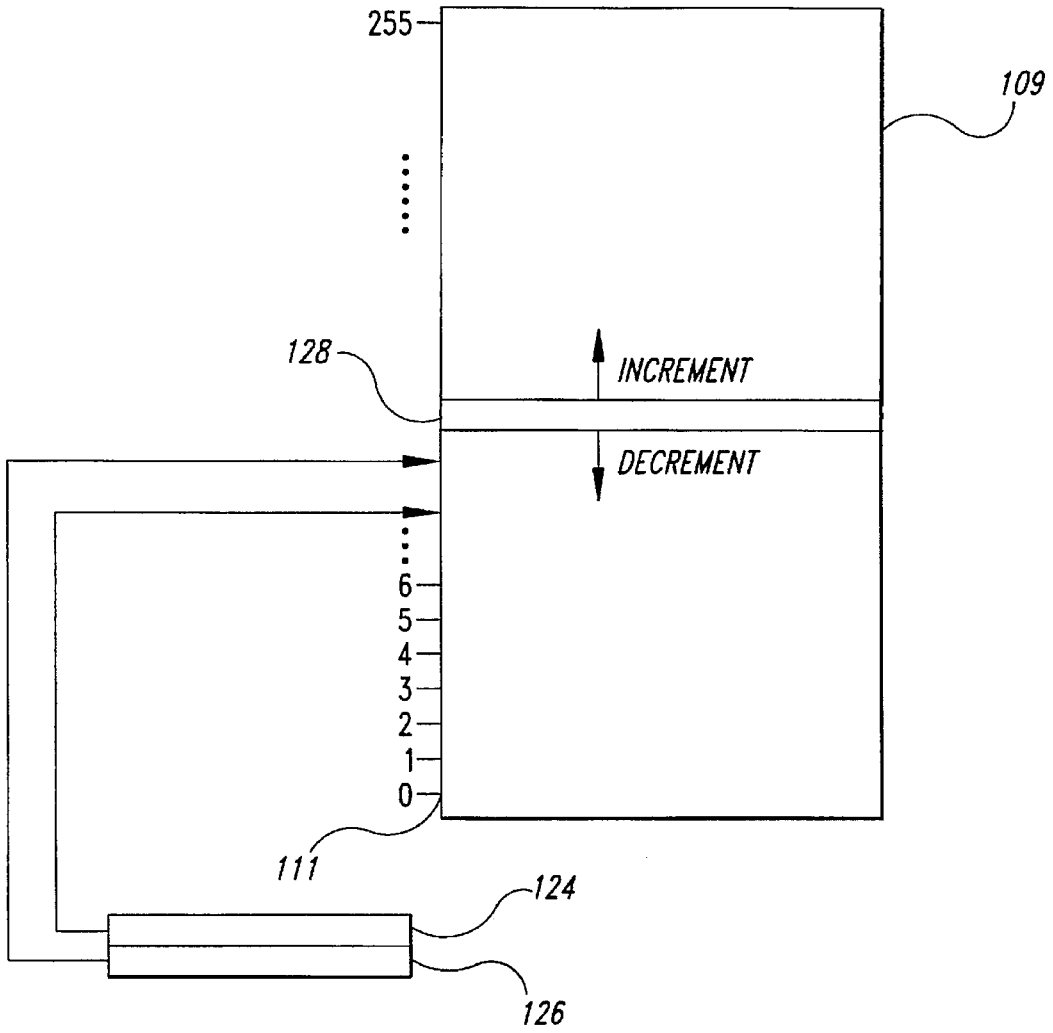
FIG. 6 is a block diagram representing a random number table and address pointers.

As can be seen in FIG. 6, the time pointer and frequency pointer do not necessarily remain equal, though they are initialized to the same value. Instead, the two pointers are allowed to drift apart. The drift between the frequency pointer and the time pointer occurs when the random number selected in step 508 is determined in step 512 to be outside of the allowed range. Then, the random number designated by the frequency pointer is rejected, the frequency pointer is incremented, and a new random number is retrieved. Thus, the frequency pointer may be incremented at times when the time pointer is not, such that the frequency and time pointers drift apart.

From the foregoing, it will be appreciated that, although embodiments of the invention have been described for purposes of illustration, various modifications may be made without deviating from the spirit and scope of the invention. Accordingly, the invention is not limited except as by the appended claims.

I claim:

1. An apparatus for transmitting a series of bursts of radiowave signals, each burst having a starting time and an ending time, each radiowave signal in each burst being transmitted at a single frequency, each burst in the series being separated from any previous burst by a respective time interval, comprising:

(a) a memory containing a plurality of memory locations, each memory location containing a random number;

(b) a first counter producing a series of frequency pointers, each frequency pointer identifying one of said memory locations;

(c) an integrated memory controller connected to receive frequency pointers from said first counter and to retrieve random numbers from said memory locations identified by said frequency pointer, said integrated memory controller producing data sequences in response thereto;

(d) a voltage supply having a digital control input connected to receive said data sequences from said integrated memory controller, said voltage supply producing supply voltages corresponding to said data sequences received at said digital control input;

(e) a voltage controlled oscillator connected to receive said supply voltages, said voltage controlled oscillator producing said radiowave signals at radio frequencies corresponding to said supply voltages, said radio frequency signals being changed only between bursts, whereby each burst contains all of the data sought to be transmitted, and each set of data in each burst being fully transmitted without any radio frequency change; and (f) a microstrip antenna coupled to receive said radiowave signals from the oscillator circuit and to transmit said radiowave signals at the frequencies of the radio frequency signals.

2. The apparatus of claim 1 wherein said voltage supply is comprised of a D/A converter.

3. The apparatus of claim 1, further including a limit memory containing limiting data corresponding to a maximum frequency and a minimum frequency, wherein said integrated memory controller is connected to retrieve said limiting data, said integrated memory controller further being connected to prevent said voltage supply from producing supply voltages corresponding to frequencies greater than said maximum frequency or less than said minimum frequency.

4. The apparatus of claim 3 wherein said voltage controlled oscillator includes a coarse adjust input and a fine adjust input, and wherein said integrated memory controller is connected to provide a first voltage to said coarse adjust input and said voltage supply is connected to provide said supply voltage to said fine adjust input.

5. The apparatus of claim 1, further comprising:

(a) a random number table containing random numbers; and (b) an interval selector connected to retrieve random numbers from said random number table, said interval selector selecting each of said time intervals in response to said random numbers retrieved by said interval selector from said random number table.

6. An apparatus for sequentially transmitting a series of groups of bursts of radiowave signals, the bursts including data from a monitoring station and carrier signals, each group in said series being transmitted at a single respective radio frequency selected from among a set of carrier frequencies, each group in said series being separated from a previous group by a variable time interval, comprising:

(a) a memory containing a plurality of memory locations, each memory location containing a random data sequence;

(b) a first counter producing a series of frequency pointers, each frequency pointer identifying one of said memory locations;

(c) a second counter producing a series of interval pointers, each interval pointer identifying one of said memory locations;

(d) an integrated memory controller connected to receive frequency pointers from said first counter and to retrieve a first series of data sequences from said memory locations identified by said frequency pointers, said integrated memory controller further being connected to receive interval pointers from said second counter and to retrieve a second series of data sequences from said memory locations identified by said interval pointer;

(e) an oscillator circuit connected to receive said first series of data sequences, said oscillator circuit producing the carrier signals at frequencies corresponding to the data sequences in said first series of data sequences;

(f) a timer connected to receive said second series of data sequences, said timer producing a series of initialization signals, initialization signal corresponding to a respective one of the groups, each initialization signal being separated from a previous initialization signal by the time interval corresponding to the respective group, said timer determining the time intervals in response to said data sequences in said second series of data sequences; and (g) a transmitter coupled to receive the carrier signal from said oscillator circuit and the data from the monitoring station, said transmitter having an initialization input connected to receive said initialization signal from said timer, said transmitter transmitting the radiowave signal at a time determined by said initialization signal.

7. The apparatus of claim 6 wherein said oscillator circuit includes:

(a) a voltage supply having a control input connected to receive said data retrieved in response to said first series of pointers, said voltage supply producing an output voltage corresponding to the data received at said control input; and (b) a voltage controlled oscillator for producing the carrier signal, said voltage controlled oscillator having a first control terminal connected to receive said output voltage from said voltage supply, wherein said voltage controlled oscillator produces the carrier signal at a radio frequency corresponding to said output voltage received at said first control terminal.

8. The apparatus of claim 7 wherein said voltage controlled oscillator circuit further includes a limit detector, said limit detector connected to limit the frequency of the carrier to a predetermined frequency range by rejecting data retrieved in response to said pointer from said first set of pointers when the data corresponds to an output voltage outside of a predetermined voltage range.

9. The apparatus of claim 7 wherein said voltage controlled oscillator includes a second control terminal connected to receive a control signal from said integrated controller, wherein the carrier frequency is determined by said control signal and said output voltage.

10. The apparatus of claim 9 wherein said timer includes a software counter.

11. A method of transmitting, via a radiowave signal, operational data produced by a monitoring station having a transmitter from the monitoring station to a remotely located receiver, comprising the steps of:

(a) generating a plurality of random numbers;

(b) storing a data sequence corresponding to each of said random numbers in a respective location in a memory;

(c) producing a first pointer identifying a first one of said locations in said memory;

(d) retrieving said data sequence from said first one of said locations;

(e) generating a control voltage corresponding to the data sequence retrieved from said first one of said locations;

(f) producing a second pointer identifying a second one of said locations in said memory;

(g) retrieving the data sequence from said second one of said locations;

(h) identifying a transmission interval in response to the data sequence retrieved from said second one of said locations;

(i) generating a carrier signal with a voltage controlled oscillator, the frequency of carrier signal corresponding to said control voltage;

(j) combining the operational data and the carrier signal to produce a modulated signal;

(k) transmitting, after the transmission interval, a radiowave signal corresponding to the modulated signal with the transmitter, the entire transmission occurring at the single carrier frequency which was selected; and (l) receiving with the receiver said radiowave signal, said receiver being tuned to said single carrier frequency which was selected.

12. The method of claim 11, wherein the step of combining the operational data and the carrier signal modulating the carrier signal with the operational data to produce a burst, and the step of transmitting a radiowave signal, comprise transmitting the burst a selected number of times, the burst being spaced apart in time by a selected time period, each burst containing the same data and each burst being transmitted on a single radio frequency.

13. The method of claim 11 wherein the step of generating a control voltage includes the steps of:

(a) retrieving fine adjust data from a fine adjust memory;

(b) retrieving a limit sequence from a limit location; and (c) producing a control voltage corresponding to the retrieved fine adjust data if the fine adjust data represents a number less than said limit sequence, or rejecting the fine adjust data if the fine adjust data represents a number greater than said limit sequence.

14. The method of claim 11, further including the steps of:

(a) producing a coarse adjust voltage; and (b) applying said coarse adjust voltage to said voltage controlled oscillator.

15. The method of claim 11 wherein said step of generating a control voltage comprises the step of applying the data sequence retrieved from said first one of said locations to a D/A converter.

* * * * *